United States Patent [19]

Cartwright et al.

[11] Patent Number: 4,481,888

[45] Date of Patent: Nov. 13, 1984

[54] SAFES

[75] Inventors: Winston G. Cartwright, Talke; Alan Gater, Porthill, both of England

[73] Assignee: Darglen Engineering Limited, Staffordshire, England

[21] Appl. No.: 323,923

[22] Filed: Nov. 23, 1981

[30] Foreign Application Priority Data

Jan. 3, 1981 [GB] United Kingdom ..... 8100058

[51] Int. Cl.[3] ..... E05G 1/04

[52] U.S. Cl. ..... 109/50; 109/59 R; 292/256.65

[58] Field of Search ..... 292/256.65, 256.67; 220/319, 323; 109/50, 52, 58.5, 59

[56] References Cited

U.S. PATENT DOCUMENTS

| | | | |
|---|---|---|---|
| 1,056,016 | 3/1913 | Fish | 109/59 |
| 1,162,703 | 11/1915 | Loew | 292/256.65 |
| 2,037,240 | 4/1936 | Johnson | 292/256.65 |
| 2,935,955 | 5/1960 | Mann, Jr. | 109/59 |
| 4,315,577 | 2/1982 | Bernson, Jr. | 292/256.65 |

FOREIGN PATENT DOCUMENTS

| | | | |
|---|---|---|---|
| 490788 | 1/1930 | Fed. Rep. of Germany | 292/256.65 |

*Primary Examiner*—Gene Mancene
*Assistant Examiner*—David L. Tarnoff
*Attorney, Agent, or Firm*—Staas & Halsey

[57] ABSTRACT

A safe has a generally cylindrical chamber having at one end an access opening in which a closure can be located. Peripheral grooves around the closure and the access opening are aligned when the closure is in position. A sliding bolt in the closure can displace a ring which is captive in one of the grooves to an eccentric position relative to the opening, in which position the ring engages both of the grooves around approximately half of their peripheries to lock the closure in the opening.

11 Claims, 5 Drawing Figures

SAFES

BACKGROUND AND SUMMARY OF INVENTION

This invention relates to safes, and in particular to an improved means for lockably securing closure members for safes.

It is known, for example from UK Pat. No. 1299858 to provide safe closure members in which bolts are mounted for sliding movement so as to engage with abutments in an opening of the safe body, and to provide a locking device which will prevent the bolts from being withdrawn. It is a disadvantage of such known arrangements that the bolts engage the safe body at discrete locations, whereby destruction of the bolts, or of the parts of the safe body which these bolts engage, will enable the closure member to be removed. This is particularly the case when, in accordance with a usual practice, the bolts engage under a relatively thin flange or rim of the safe opening.

It is an object of the present invention to provide a safe in which locking is not principally effected by engagement of one or more bolts with the safe body and in which unauthorised removal of the closure member is resisted by the safe body as a whole, rather than by a flange or rim on the body.

A safe according to the invention comprises a chamber having an access opening and a closure which is movable into and out of said opening, first and second peripheral grooves around said opening and said closure respectively, means on said opening and said closure for locating said closure within said opening so that said first and second grooves are substantially aligned, an element which is captive in one of said grooves and which surrounds said closure when the latter is located in said opening, a member slidable in said closure to a locking position in which said member engages said element to displace the latter to a position in which said element engages both said first and said second grooves, and latching means for engagement with said slidable member to maintain the latter in its locking position.

An embodiment of the invention will now be described by way of example only and with reference to the accompanying drawings, in which:

DESCRIPTION OF THE PREFERRED EMBODIMENT

Figure 1:
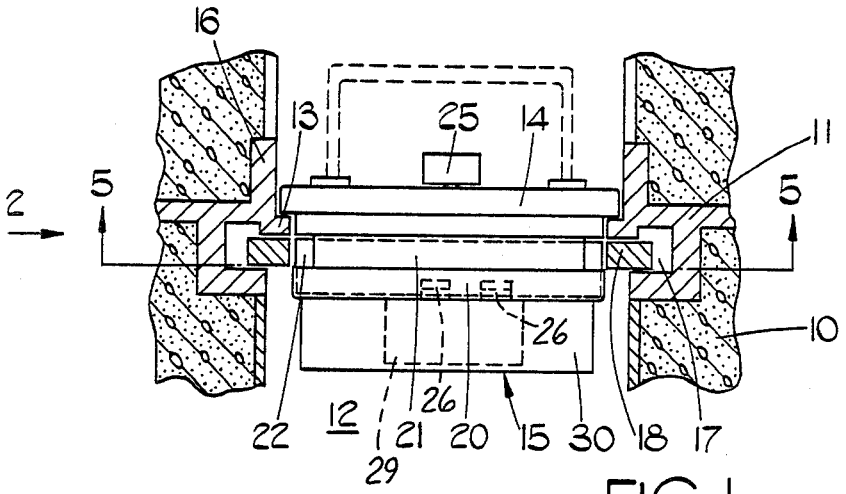
FIG. 1 is a section through an access opening of a safe chamber, with a closure located therein.
Figure 2:
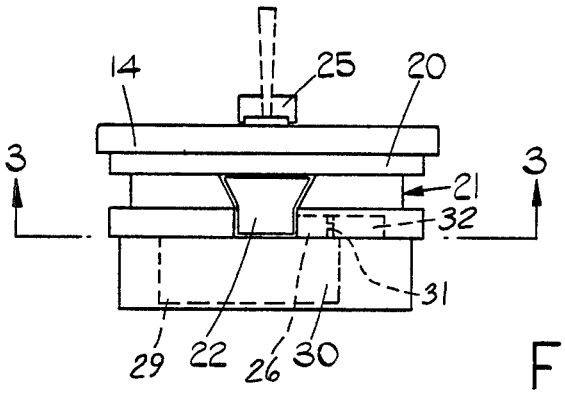
FIG. 2 is a view of the closure, an arrow 2 in FIG. 1.

In the particular embodiment described the safe is a floor safe of circular section and is mounted within a concrete mass, indicated at 10 so that an upper flanged portion 11, which defines an access opening for the safe chamber (indicated at 12) is securely bedded within the mass 10. The portion 11 has a lip 13 for locating a flange 14 on a closure 15 for the safe. An axially-extending wall 16 of the portion 11 co-operates with the flange 14 to locate the closure 15 radially of the access opening. A peripheral groove 17 in the portion 11 has a hardened steel annular element 18 mounted therein for free sliding movement in directions radially of the access opening. The dimensions of the element 18 and groove 17 are such that the element 18 is retained captive in the groove 17. Moreover, as shown in FIGS. 1 and 4, the groove 17 extends radially outwards of the portion 11, so that with the element 18 in a position of maximum eccentricity with respect to the opening in the portion 11 a substantial part of the element 18 will lie beneath the axially extending wall 16.

Figure 3:
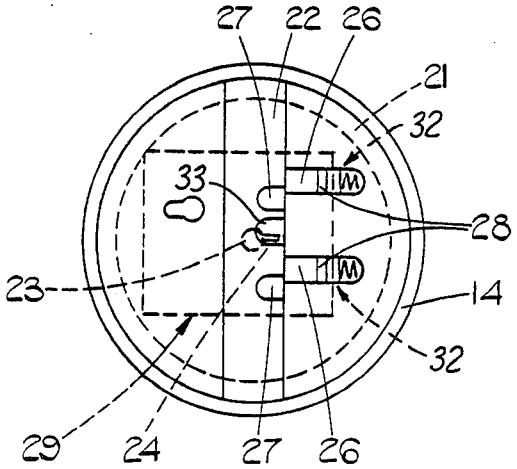
FIG. 3 is a section on line 3—3 in FIG. 2.

The closure 15 has a steel body 20 having a peripheral groove 21 which is located with respect to the flange 14 so that when the flange 14 engages the lip 13 the grooves 17, 21 are axially aligned. the dimensions of the groove 21 are such that in the aforesaid position of maximum eccentricity of the element 18 with respect to the access opening, the element 18 can freely enter the groove 21. Mounted for sliding movement in the body 20 is a member 22 which has a dovetail section for maintaining it captive within the body 20. The length of the member 22 is, as shown more clearly in FIG. 3 such that when it is in its unlocked position its ends lie flush with the parts of the body on either side of the groove 21. The member 22 is movable in one direction only from the aforesaid unlocked position by means of a spindle 23 (FIG. 3) which carries a pin 24 engaging an aperture 33 in the member 22. The spindle 23 is rotatable by a knob 25 which projects above the body 20.

Figure 4:
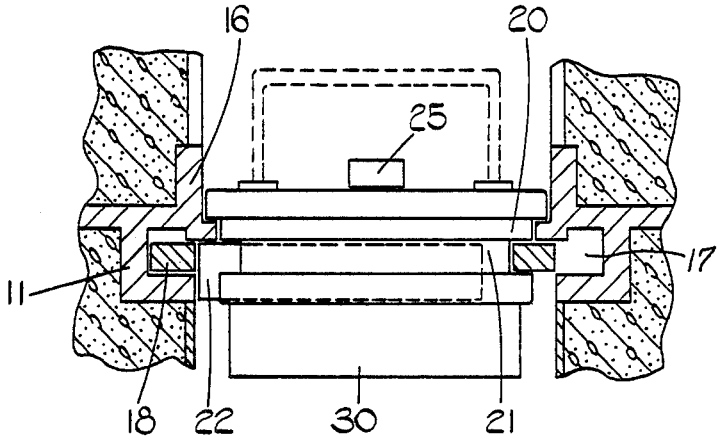
FIG. 4 is a view corresponding to FIG. 1, with the closure in locking engagement with the safe chamber.

In the locked position of the member 22, indicated in FIG. 4, spring-biassed latching elements 26 which are slidable in recesses 32 in the body 20 engage slots 27 in the member 22 to maintain the latter in its locked position. Each of the elements 26 has a transverse recess 28 which is engaged by a projection 31 of a key-operated lock unit, indicated at 29 in FIG. 3, the arrangement being such that operation of the key in one direction urges the elements 26 against their springs to release the member 22, and operation of the key in the other direction allows the elements 26 to engage in the slots 27, providing that the element 22 is itself in its locking position. The lock unit 29 is such that the key cannot be removed therefrom until it is in a position which corresponds to engagement of the element 26 with the member 22. The lock unit 29 is not secured to the body 20, but is located in position thereon by a plastics cover 30 which is itself secured to the body 20. As a result, if the closure becomes excessively hot, for example as a result of application of a cutting torch, the cover 30 will melt and allow the lock unit 29 to drop away, and the member 22 cannot thereafter be unlatched, and is retained in its locking position. The cover 30 will also tear away from the body 20, to drop the lock unit 29, if a downward force is applied to the lock unit 29, for example by means of a drill through the body 20.

Figure 5:
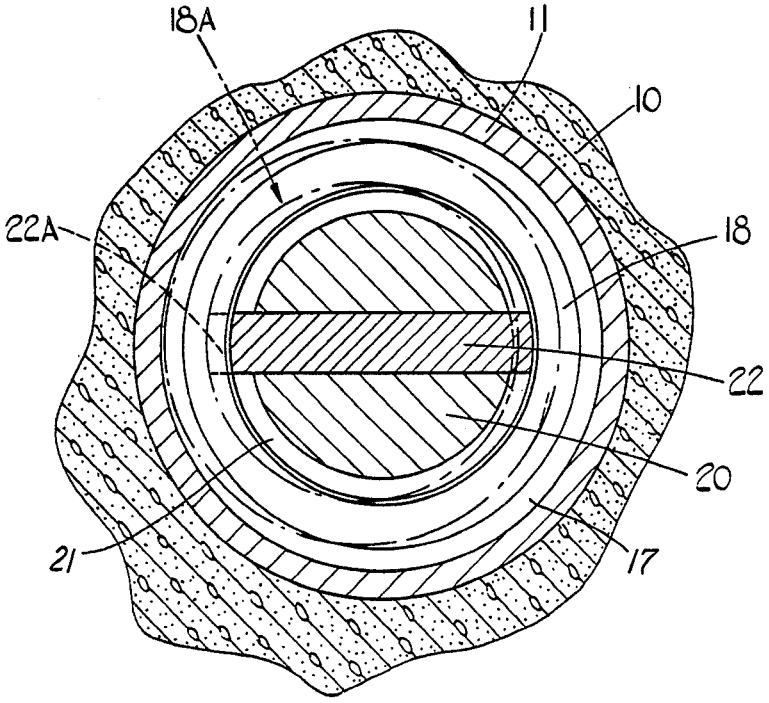
FIG. 5 is a section on line 5—5 in FIG. 1, and also indicating the condition during locking engagement.

With the member 22 in its locking position as indicated in FIG. 4, and at 22A in FIG. 5, the annular element 18 is displaced to an eccentric position with respect to the access opening of the safe, as indicated in chain-dotted line in FIG. 5, in which position both the groove 17 in the portion 11 and the groove 21 in the closure are engaged by the element 18 over approximately half the circumference thereof. The projecting part of the member 22 can abut the portion 11 immediately below the wall 16, to prevent upward movement of a side of the closure 15 which is generally opposite to the arc over which the element 18 engages both the grooves 17 and 21. Locking engagement, by way of the element 18, and the member 22, between the closure and the portion 11 of the safe body is thus effected over substantially half of the circumference of the access opening and is, moreover, in the region of the axially-extending wall 16 which is, in turn, bedded securely in the surrounding concrete mass 10.

Since the portions of the body 20 on either side of the groove 21 have diameters which have only small clearance inside the lip 13 of the portion 11, the closure cannot be inserted into the access opening unless the member 22 is fully withdrawn to its unlocked position. As indicated above in that position of the member 22 the key of the lock unit 29 cannot be withdrawn and thus provides an indication that the safe is not locked.

We claim:

1. A safe comprising a chamber having an access opening and a closure which is movable into and out of said opening, first and second peripheral grooves in said opening and said closure respectively, means on said opening and said closure for locating said closure in said opening so that said first and second grooves are substantially aligned, a rigid annular element which is captive in one of said grooves and which is movable between an unlocked position in which there is clearance between said element and the other of said grooves, and a locked position in which said element engages both of said grooves, in both of which locked and unlocked positions said element surrounds said closure when the latter is located in said opening, and a member slidable in said closure transversely of the axis of said element, said member being engageable with said element to urge the latter in respective opposite directions between said locked and unlocked positions.

2. A safe as claimed in claim 1, in which said chamber is of circular section and said opening is defined by an axially extending portion of the wall of said chamber, said first groove underlying said wall portion.

3. A safe as claimed in claim 1 or claim 2 in which said slidable member, in its locking position, engages said first groove at a location generally opposite to an arc over which said element engages both of said first and second grooves.

4. A safe as claimed in claim 3, in which locking engagement between said closure and said access opening, by way of said element and said slidable member, extends around substantially half of the periphery of said opening.

5. A safe as claimed in claim 1, in which said latching device is located on a portion of said closure which faces inwardly of said chamber by means of a plastics member.

6. A safe as claimed in claim 1 in which in said unlocked position of said element the latter is captive in said first groove only.

7. A safe as claimed in claim 1 which includes latching means engageable with said slidable member for maintaining the latter in a position in which said annular element is urged to said locking position.

8. A safe comprising a chamber having a substantially circular access opening and a substantially circular closure which is movable into and out of said opening, first and second peripheral grooves in said opening and said closure respectively, means on said opening and said closure for locating said closure in said opening so that said first and second grooves are substantially aligned, a rigid annular element which is captive in one of said grooves and which is movable between an unlocked position in which it is concentric with said opening and said closure, and a locked position in which it is eccentric with respect to said opening and said closure and engages both of said grooves, and a member slidable in said closure in directions transversely of the axis thereof, for urging said annular element in respective directions between said locked and unlocked positions.

9. A safe as claimed in claim 8 in which said means for moving said element comprises a member slidable in said closure and engageable with said element to move the latter between said unlocked and locked positions.

10. A safe as claimed in claim 9 which includes a spring biassed latch engageable with said slidable member to maintain the latter in a position in which said element is maintained in its locked position.

11. A safe as claimed in claim 8 which includes latching means engageable with said slidable member for maintaining the latter in a position in which said annular element is urged to said locking position.

* * * * *

UNITED STATES PATENT AND TRADEMARK OFFICE

CERTIFICATE OF CORRECTION

PATENT NO. : 4,481,888

DATED : November 13, 1984

INVENTOR(S) : CARTWRIGHT et al.

It is certified that error appears in the above-identified patent and that said Letters Patent is hereby corrected as shown below:

Title page:

(73) Assignee: delete"Darglen Engineering Limited, Staffordshire, England" and insert --Ademco-Sontrix Limited, Berkshire, England--.

Signed and Sealed this

*Eleventh* Day of *June 1985*

[SEAL]

*Attest:*

DONALD J. QUIGG

*Attesting Officer*

*Acting Commissioner of Patents and Trademarks*